US005515753A

United States Patent [19]

Wagner et al.

[11] Patent Number: 5,515,753

[45] Date of Patent: May 14, 1996

[54] POWER WRENCH

[75] Inventors: Paul-Heinz Wagner, Haus Nr. 70, 53810 Much-Birrenbachshoehe; Klaus Ruessmann, Koenigswinter; Thomas Beyert, Much, all of Germany

[73] Assignee: Paul-Heinz Wagner, Germany

[21] Appl. No.: 299,431

[22] Filed: Sep. 1, 1994

[30] Foreign Application Priority Data

Sep. 10, 1993 [DE] Germany ..... 9313711 U

[51] Int. Cl.[6] ..... B25B 13/46

[52] U.S. Cl. ..... 81/57.39; 81/57.44

[58] Field of Search ..... 81/57.39, 57.44, 81/57.4; 92/3, 59, 169.1, 171.1, 172, 174, 179, 187, 255–256

[56] References Cited

U.S. PATENT DOCUMENTS

| | | | |
|---|---|---|---|
| 3,272,088 | 9/1966 | Kistler | 92/59 |
| 4,805,496 | 2/1989 | Wagner et al. . | |
| 4,854,197 | 8/1989 | Walton | 81/57.39 |
| 4,982,626 | 1/1991 | More et al. | 81/57.39 |
| 5,165,375 | 11/1992 | Hu | 92/187 X |
| 5,167,182 | 12/1992 | Sims | 92/59 |
| 5,263,388 | 11/1993 | Beuke . | |
| 5,311,797 | 5/1994 | Ruessmann et al. | 81/57.39 |

*Primary Examiner*—D. S. Meislin
*Attorney, Agent, or Firm*—Diller, Ramik & Wight

[57] ABSTRACT

The power wrench comprises a housing (10) consisting of a head portion (11) and a driving portion (12). The driving portion (12) includes a cylinder bushing (21) which is introduced into the housing (10) through an opening (22) on the side facing away from the head portion (11). The cylinder bushing (21) with the piston (28) contained therein can easily be exchanged. With a lock connection, the piston rod (29) engages the pivotable lever (17) included in the head portion so that it can be pulled off by the lever (17).

6 Claims, 2 Drawing Sheets

POWER WRENCH

BACKGROUND OF THE INVENTION

The invention relates to a pressure-actuated power wrench comprising a cylinder bushing within a housing, a piston being displaceable within the housing and reciprocatingly driving an annular piece via a rotatably supported lever.

A power wrench disclosed in U.S. Pat. No. 4,805,496 or U.S. Pat. No. 5,263,388 comprises a housing consisting of a head portion and a driving portion. The driving portion includes an exchangeable cylinder bushing which is introduced, from the interior of the head portion, into a corresponding bore of the driving portion, and is supported on the end wall of the driving portion which faces away from the head portion. The cylinder bushing is mounted from the interior of the head portion. This has to be done prior to the mounting of the lever and the annular member. When the cylinder bushing, which has to withstand very high pressures in the magnitude of 600–800 bar, has become defect, e.g. due to cracking, or when the piston has to be renewed, the entire power wrench has to be dismounted. In this case, the annular member and the lever have to be taken out of the housing first.

SUMMARY OF THE INVENTION

It is the object of the present invention to provide a power wrench comprising a cylinder bushing arranged in the housing, which can easily be assembled and, if necessary, be dismounted to replace wearing parts.

In the power wrench according to the invention, the opening through which the cylinder bushing is mounted is located on the housing end face facing away from the head portion. This opening is sufficiently large for the cylinder bushing to be pushed therethrough. Subsequently, the cylinder bushing is fixed in the housing, e.g. by screwing or by closing the opening by means of a strong lid, so that the pressure force acting in the cylinder cannot press the cylinder bushing through the opening.

Mounting the cylinder bushing from the housing end has the further advantage that cylinder bushings of different lengths can be used while the overall length of the housing is relatively short. There is the possibility that a specific cylinder bushing of great length projects out of the housing. Accordingly, the length of the driving portion of the housing can be dimensioned corresponding to the overall length of the shortest cylinder bushing. Longer cylinder bushings partially project from the housing. Longer cylinder bushings are used, for example, when the resetting force for the piston is produced by a spring and not by pressure fluid. A cylinder bushing with a resetting spring requires a greater axial length.

Thus, the power wrench according to the invention can be manufactured in different functional types which only differ regarding the inserted unit of cylinder bushing and piston.

According to a preferred embodiment of the invention, the piston rod engages the lever by means of an extractable lock connection. This has the advantage that the piston can be drawn out of the housing whereas the lever and the annular member remain in the housing. In order to remove the piston, it is only necessary to before take out the cylinder bushing. Upon reinsertion of the piston together with the cylinder bushing, the end of the piston rod is caught by the lever whereupon the lock connection engages. During the working stroke of the piston, the end of the piston rod acts pressingly on the lever, the lock connection not being strained. During the return stroke of the piston, the piston rod pulls the lever along without greater force. This return movement performed with low force does not involve the danger of releasing the lock connection.

BRIEF DESCRIPTION OF THE DRAWINGS

Hereinafter, embodiments of the invention are described in more detail with reference to the drawings, in which.

DESCRIPTION OF THE PREFERRED EMBODIMENTS

Figure 1:
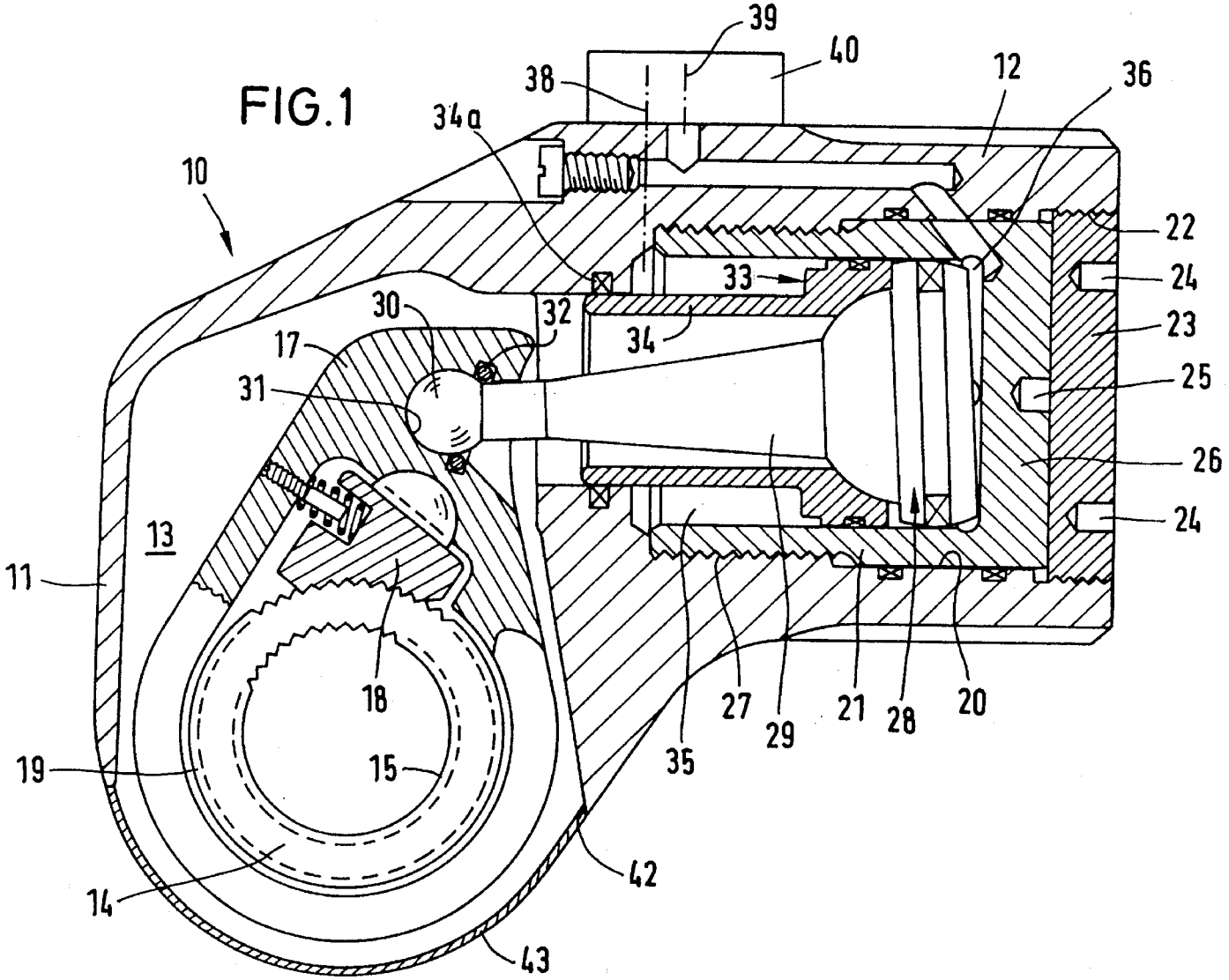
FIG. 1 is a longitudinal sectional view of a first embodiment of the power wrench with a double-acting cylinder.

The power wrench according to FIG. 1 comprises an integral housing 10 consisting of a head portion 11 and a driving portion 12. The head portion 11 has a working chamber 13 defined by two parallel plate-shaped walls. The annular member 14 is rotatably supported in these walls. The annular member 14 includes an opening with a profile toothing 15, into which the shaft of a button die can be inserted which may be set on the head of the screw to be turned.

The annular member 14 supports a lever 17 comprising a spring-tensioned ratchet element 18 which can be brought into engagement with an outer ratchet toothing 19 of the annular member. The ratchet element 18 is arranged and supported on the lever 17 in such a manner that the lever 17 pulls the annular member 14 always in one rotational direction only, but can be returned in the other rotational direction without rotating the annular member.

The cylinder bushing 21 is arranged in a bore 20 in the driving portion 12. The housing opening 22 from which the cylinder bushing 21 is inserted into the housing is located on the outer end of the driving portion 12 facing away from the head portion 11.

This opening 22 is provided with a thread into which a lid 23 is screwed. On its outside, the lid 23 has bores 24 into which a tool for rotating the lid can be introduced. Similar bores 25 are located on the outside of the bottom 26 of the cylinder bushing 21. This bottom 26 is supported on the lid 23.

Further, the cylinder bushing 21 is provided with an external thread 27 at its front end facing the head portion 11; this external thread extends over about half of the length of the cylinder bushing and is screwed into an internal thread of the bore 20.

The cylinder bushing 21 forms the hydraulic cylinder wherein the piston 28 is displaceable. Here, the piston 28 is formed as a spherical piston which can take different pivotal positions in the cylinder bushing while forming a seal with respect to the cylinder wall. The piston rod 29 is rigidly attached to this piston 28. A spherical head 30 seated in a spherical bearing 31 of the lever 17 is located at the end of the piston rod 29. At this bearing 31, a locking device 32 in form of a clamping ring spring arrangement is provided which encompasses the head 30 and thereby retains it in the bearing 31. When the head 30 is pressed against the lever 17, the locking device 32 is radially extended to close again behind the head 30 and thus retain the head in the bearing 31.

Apart from the piston 28, an auxiliary piston 33 for the return stroke is provided in the cylinder bushing. This auxiliary piston 33 has a cylindrical circumferential piston surface so that it cannot be tilted. A sleeve 34 projects from the auxiliary piston 33 towards the working chamber 13. A seal 34*a* encompassing the sleeve 34 and sealing the front cylinder chamber 35 is provided in the connection wall between the head portion 11 and the driving portion 12. The forward cylinder chamber 35 is limited by the auxiliary piston 33, and the rearward cylinder chamber 36 by the piston 28 and the bottom 26.

The forward cylinder chamber 34 is connected to a line 38 and the rearward cylinder chamber 36 is connected to a line 39. Via a connection device 40, hoses can be connected to the lines 38 and 39.

When the power wrench is in operation, a working stroke is performed by pressurizing the line 39 while the line 38 is pressureless. The piston 28 is advanced by the pressure in the cylinder chamber 37, the piston rod 29 pressing against the lever 17 and rotating the annular member 14 via ratchet element 18. The piston 28 pushes the auxiliary piston 33. In the return stroke, the line 38 is pressurized while the line 39 is pressureless. The auxiliary piston 33 is driven by the pressure in the cylinder chamber 35, thus, it pushes the piston 28 in its rearward end position.

At that part of the circumferential wall of the head portion 11 which faces away from the lever 17, a mounting opening 42 is provided which is closed by a detachable lid 43. When the lid is detached, the unit of annular member 14 and lever 17 can be mounted in the housing through the mounting opening 42.

For mounting the unit of cylinder bushing 21 and the two pistons 28 and 33, this unit is introduced into the housing through the opening 22.

Figure 2:
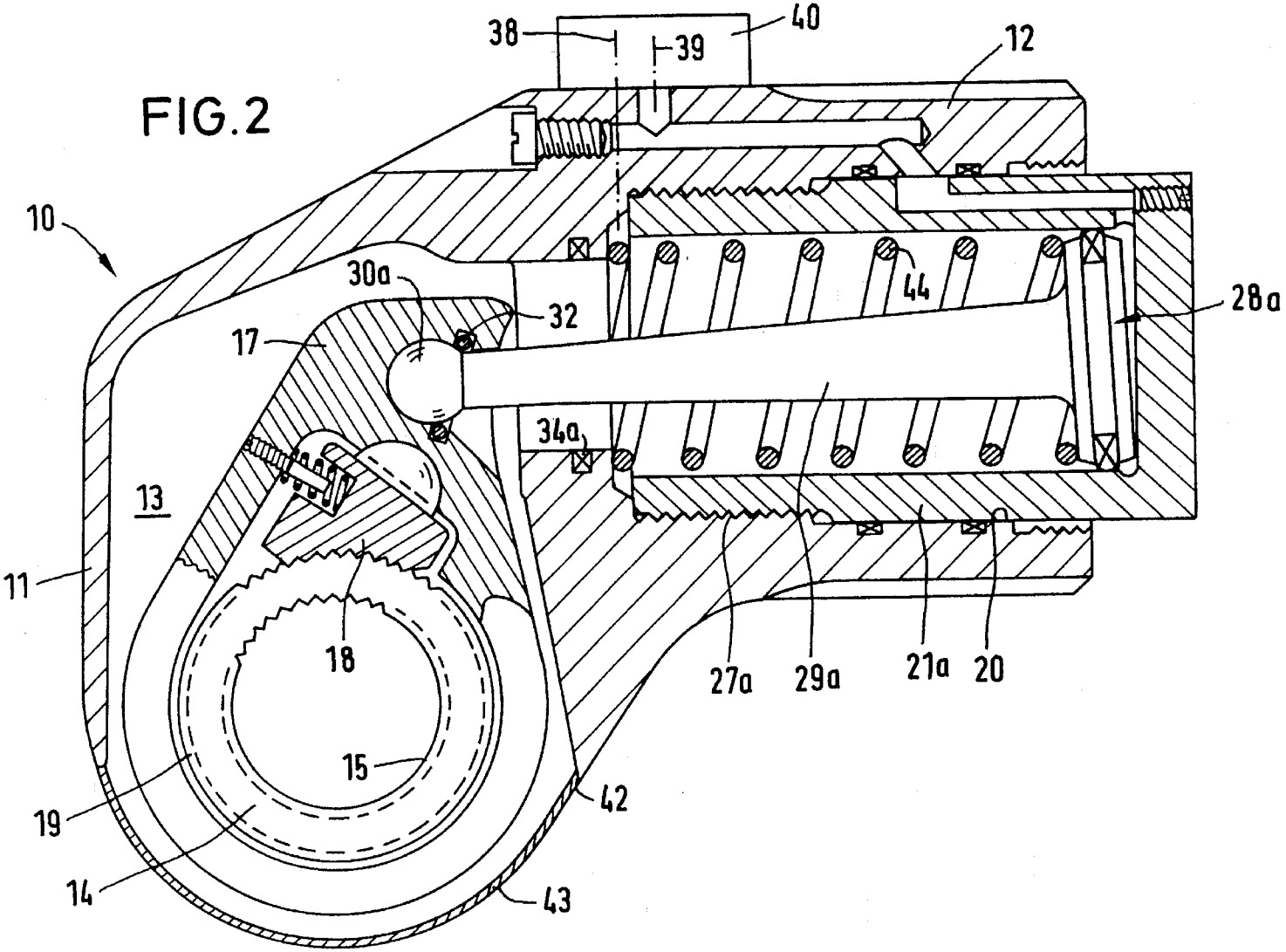
FIG. 2 shows a second embodiment with a single-acting cylinder.

In the embodiment of FIG. 2, the housing 10 is the same as that of the first embodiment. The piston-cylinder unit introduced into the housing 10, however, is different. The cylinder bushing 21*a* has a greater length than cylinder bushing 21 and it projects out of the driving portion 12 of the housing 10. With an external thread 27*a*, the cylinder bushing 21*a* is screwed into an internal thread of the bore 20. The lid 23 is not used.

There is no auxiliary piston 33 in the second embodiment. The resetting force for the piston 28*a* is generated by a spring 44 which is arranged in the cylinder bushing 21*a* and presses against the piston 28*a* with one end, while the other end is supported on that partioning wall of the housing 10 through which the piston rod 29*a* projects. A greater length of the cylinder bushing 21*a* is required owing to the spring 44.

Optionally, the same housing 10 can be used with the double-acting piston-cylinder unit according to FIG. 1 or with the single-acting piston-cylinder unit according to FIG. 2. The piston-cylinder unit can be easily exchanged in the above-described manner.

We claim:

1. A power wrench comprising a housing (10) including a head portion (11) within which is a rotatably supported annular member (14) and a rotatably supported lever (17) for pulling on the annular member (14), said housing (10) further including a driving portion (12) housing a cylinder bushing (21) defining a cylinder chamber (35) with a piston (28) movable therein whose piston rod (29) engages the lever (17) via a joint (30, 31), said joint (30, 31) including a substantially spherical bearing (31) housing an enlarged head (30) matching the spherical bearing (31), the piston rod (29) engaging the lever (17) by extractable holding connection means in the form of elastic element means (32) which retains the enlarged head (30) seated in the bearing (31), said elastic element means (32) is a clamping ring spring (32) which effects free snap insertion of said enlarged head (30) into said bearing (31) and free snap removal of said enlarged head (30) from said bearing (31), said cylinder bushing (21) is adapted to be introduced into the housing (10) through an opening (22) arranged at an outer end of a driving portion (12) of said housing (10) which faces away from said head portion (11), and said cylinder bushing (21) is mounted in said driving portion (12) by a locking closure (23) releasable exteriorly of said housing (10).

2. The power wrench of claim 1, wherein a mounting opening (42) for introducing the annular member (14) and the lever (17) into the housing is arranged on the circumference of the annular member on the side facing away from the lever (17).

3. The power wrench of claim 1, wherein the cylinder bushing (21) is screwed into the housing (10) by means of a thread (27).

4. The power wrench of claim 1, wherein the cylinder bushing (21) is supported by said locking closure (23) in the form of a lid (23) detachably mounted in the opening (22).

5. The power wrench of claim 1, wherein the cylinder bushing (21*a*) projects out of the housing (10).

6. The power wrench of claim 1, wherein at least two different cylinder bushings (21,21*a*) are provided which can optionally be inserted into the housing (10).

* * * * *